United States Patent [19]

Zalewski

[11] 3,961,457

[45] June 8, 1976

[54] METHOD OF BUILDING CONSTRUCTION

[76] Inventor: Waclaw P. Zalewski, 15 Goden St., Belmont, Mass. 02178

[22] Filed: May 2, 1974

[21] Appl. No.: 466,404

[52] U.S. Cl. ..... 52/743; 249/26; 264/35

[51] Int. Cl.[2] ..... E04G 21/00; E04G 11/02

[58] Field of Search ..... 249/27, 26; 264/31, 264/34, 33, 35; 52/741, 743

[56] References Cited

UNITED STATES PATENTS

| | | | |
|---|---|---|---|
| 980,480 | 1/1911 | Bishop | 249/27 |
| 1,279,472 | 9/1918 | Springer | 264/34 |
| 1,428,953 | 9/1922 | Garlinghouse | 249/26 |
| 1,461,426 | 7/1923 | Lisowski | 249/26 |
| 1,516,074 | 11/1924 | Borg | 52/283 |
| 1,967,968 | 7/1934 | O'Meara | 264/35 |

*Primary Examiner*—Ernest R. Purser
*Assistant Examiner*—James L. Ridgill, Jr.
*Attorney, Agent, or Firm*—Richard J. Birch

[57] ABSTRACT

A method of building construction which utilizes prefabricated floor elements and cast in situ support elements therefor. Forms are erected at horizontally spaced locations with each form defining a vertical support section and at least one horizontal support section. A prefabricated floor element is positioned on the horizontal support sections of the forms with the floor element partially spanning the horizontal distance between the vertical support sections of the forms. Concrete is then poured into the forms and, after setting, forms a support element having a vertical portion and at least one horizontal portion with the horizontal portion forming a rigid connection with the prefabricated floor element. The cast in situ support elements can be a wall, column or the like. After setting, the forms are removed and the process repeated in a horizontal and/or vertical dimension.

10 Claims, 5 Drawing Figures

METHOD OF BUILDING CONSTRUCTION

BACKGROUND OF THE INVENTION

Figure 1:
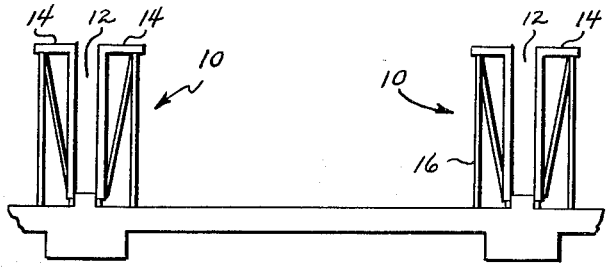

This invention relates to building construction methods in general and, more particularly to a method of building construction which combines the use of prefabricated floor elements with cast in situ supports for the floor elements.

Existing industrialized construction systems ranging in application form low-rise to high-rise residential, parking, industrial, laboratory, school and office buildings use factory components which are assembled into buildings at the construction site. These cover a gamut of alternatives ranging from pre-fabrication of structural members such as frames, beams, floor and wall panels, to the manufacturing of completely pre-finished and pre-furnished modular components.

It is well known that economic efficiency through industrialization is based on long production runs of identical or highly similar manufactured elements. In building construction this is possible only when a large number of buildings in a given geographic area, within a given time frame require similar components.

Standardized mas-produced floor elements (prestressed concrete planks and steel bar joists) which can be easily incorporated into almost any design are presently available in virtually every part of this country. There are, however, inherent difficulties in the standardization of structural supports (walls, columns, frames). As a result, known building systems in the United States rarely achieve full economic benefits of industrialization.

Thus, in the present U.S. construction market which continues to be dominated by conventional or semi-conventional construction methods, short of modifying free market conditions, what is needed is a building method based on a middle course approach between conventional nonefficiencies and the rigid limitations of full industrialization.

It is accordingly a general object of the invention to provide an improved method of building construction.

It is a specific object of the invention to provide a method of building construction which employs prefabricated floor elements and cast in situ supports therefor.

It is a feature of the invention that the method of building construction provides economics in materials and labor.

It is still another feature of the invention that the invention thereof permits design flexibility with a wide degree of versatility in terms of building applications and local conditions.

BRIEF SUMMARY OF THE INVENTION

The method of the present invention is based upon the use of poured-in-place T-shaped structural supports (walls, columns, or frames, together with a portion of a floor) combined monolithically with prefabricated floor elements (concrete planks or metal desk on steel joists).

The resulting composite structure benefits from the economies of:

1. use of standarized, technically superior, mass-produced floor elements which achieve longer spans, lighter weight and better quality than cast-in-place sitebuilt floors and, 2. cast-in-place supports and adjacent strips of floors for which standardization and economic mass production has not been achieved due to widely varying functional requirements within a given building and even greater variations from building to building.

At the same time, the method is free of all inherent deficiencies of existing industrialized systems such as known difficulties encountered in joining methods, factory vs. field tolerances, and their frequent negative effects on structural reliability and time of completion. These factors are particularly significant in high-rise buildings where full protection against effects of earthquake, high winds, and progressive collapse must be considered.

The special forms are easily and quickly lifted and located into place. Before concrete is poured into the forms, the prefabricated floor elements (reinforced or pre-stressed concrete planks or metal deck on steel joists) are placed between and supported by the edges of the inverted L-shaped forms. The equipment used for handling of forms is also used for lifting the floor elements and placing of the cast-in-place concrete. When concrete is poured into the forms, it embeds the specially prepared ends of the floor elements and connects them with the supports into one simple, precise, monolithic system.

Figure 2:
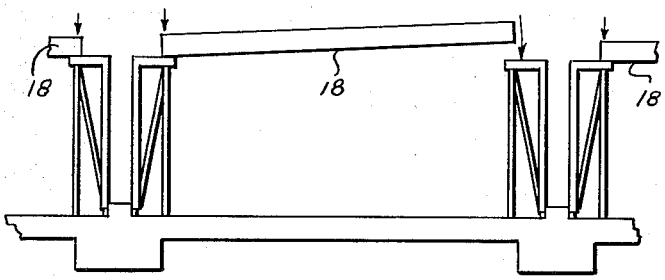
Figure 3:
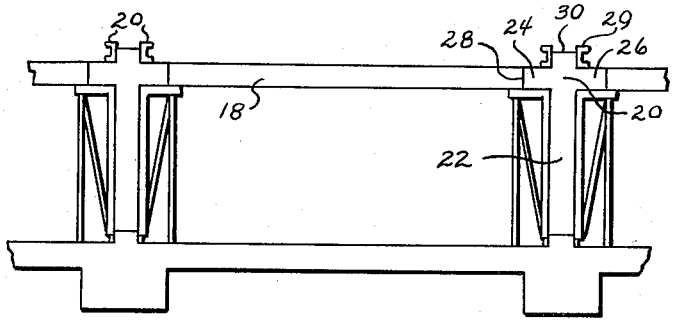
Figure 4:
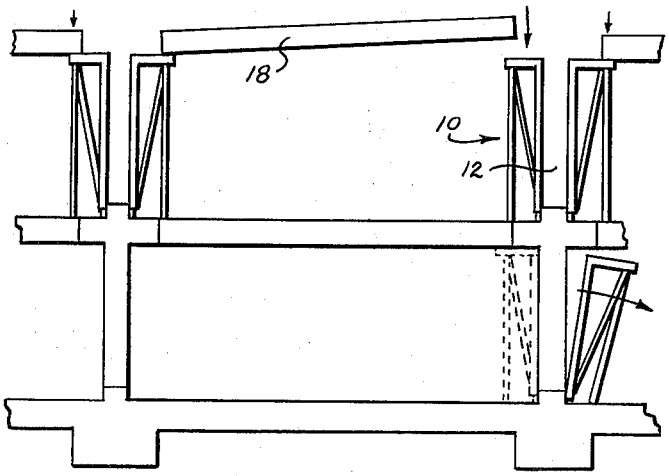
Figure 5:
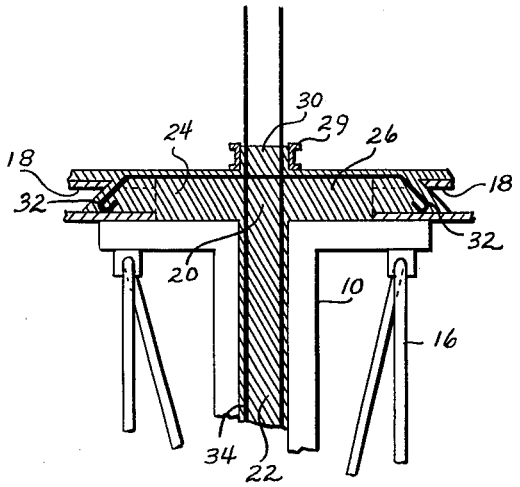

The objects and features of the invention will best be understood from a detailed description of a preferred embodiment thereof selected for purposes of illustration and shown in the accompanying drawings, in which:

FIGS. 1 through 4 are diagrammatic views in side elevation of the assembly steps of the method of the present invention with FIG. 1 illustrating the positioning of the forms at a first floor, FIG. 2 showing the placement of prefabricated floor elements at the first floor; FIG. 3 depicting the pouring of concrete for supporting elements at the first floor; and FIG. 4 showing the placement of prefabricated floor elements at the second floor, and the removal (and if desired), rotation of the forms; and, FIG. 5 is an enlarged detailed view in side elevation and partial section depicting the rigid connection between the prefabricated floor element and the cast in situ support therefor.

Turning now to the drawings, FIGS. 1 through 4 illustrate in diagrammatic form the sequence of steps of the method of the preferred embodiment of the invention. Two forms 10 for a setable plastic material, such as, concrete are erected at a first floor level. Each form 10 defines a vertical support section 12 and at least one horizontal support section 14. Suitable bracing 16 is provided to maintain the form 10 in position during the pouring and setting of the concrete. For purposes of clarity, the end walls of forms 10 have been omitted. However, it should be understood that the forms included such walls to define a chamber to hold the plastic material during the setting or hardening time.

Looking at FIG. 2, a prefabricated floor element 18 is positioned on the horizontal support sections 14 of the two forms and partially spans the distance between the vertical support sections of the forms. Preferably, the length of the prefabricated floor element 18 is in the range of 70% to 90% of the distance between the vertical support sections. Although the term "floor" has been used to describe the prefabricated element 18, it should be understood that the element could function as a "roof" in a one story building or as a "roof" in a multiple story building. Accordingly, the "term" floor "as used herein should be considered to cover both a conventional "floor" element as well as a "roof" element.

After the prefabricated floor element is positioned or the horizontal supports of the forms 10, the forms are filled with a settable, plastic material, which after hardening, forms a support element 20 having a vertical portion 22 and at least one horizontal portion 24. If two horizontal supports are provided on the forms, a second horizontal portion 28 will be formed by the concrete as shown in FIG. 3. The horizontal portion 24 forms a rigid connection with the prefabricated floor element 18.

If desired, the support element 20 can be provided with portion 30 which extends upwardly beyond the upper surfaces of the horizontal portions 24 and 26. The extended portion is formed by means of form walls 29. The extended portion 30 is useful in vertically aligning the forms with a previously formed support 20 in the case of a multiple story building as shown in FIG. 4.

After the concrete has hardened, the forms 10 and bracer 16 are removed for subsequent use. For a multiple story building, the forms can be rotated from floor-to-floor as the construction progresses upwardly.

FIG. 5 illustrates in enlarged detail and in partial section a representative configuration of the rigid connection between the prefabricated floor element 18 and the horizontal portion 24 (26) of the support 20. Preferably, metal connecting rods 32 are employed to help tie the two members in a rigid connection to achieve the desired monolithic structure. Normally, standard re-enforcing rods 34 are provided within each support 20.

Having described the basic steps of the invention and the components used therein it will be helpful to describe in relatively general terms the use of the method in various applications and the advantage which accrue from the method.

The standardized forms 10 may be used for a wide variety of applications. The same form is used for a wide range of floor spans and floor and wall thicknesses. Since all basic forms are identical and the amount of forms required is substantially lower when compared with conventional flat slab, forming costs are exceedingly low. Additional advantages are realized from known durability of the forms, the life expectancy of which may exceed 500 cycles, and from simplicity in handling forms as a result of special design. If the forms are insulated, the heat generated by the curing process can reduce turnover time for forms (the time the concrete must be supported by formwork) from several days to under 12 hours. In severe cold weather additional means may be employed to assure continuous production.

The inherent dimensional precision of the structure resulting from the method permits pre-manufacturing of all interior partitions, cabinetry, stairs and trim to controlled dimensions, as well as ready acceptance of modular components such as bathrooms and kitchens. The method permits setting pre-assembled reinforcing mats together with mechanical and electrical components (such as pipes, conduits, and utility boxes) into the forms with special ease and incorporating them within the concrete. Doors, windows, horizontal or vertical duct openings may also be easily framed out.

The simplicity of the method makes it especially possible to use unskilled labor. After a short period of training, green crews can effectively produce high quality results. The method's greater emphasis on local, unskilled labor provides substantial employment benefits to the local community that are often lost with building systems that are produced outside of the community in which the building site is located.

The method provides: free spans between bearing walls exceeding those of any other building system; economy and design flexibility (minimum constraints on organization of interior spaces — plan configuration may be recti - or curvilinear); highrise potential exceeding thirty stories while meeting the most severe anti-seismic requiremens; and full benefits of industrialization for one-of-a-kind buildings with almost no minimum size limitations.

Having described in detailed the preferred embodiment of my invention, it will now be apparent to those skilled in the art that numerous modifications can be made therein without departing from the scope thereof as defined in the appended claims.

What I claim and desire to secure by Letters Patent of the U.S. is:

1. A method of building construction comprising the steps of:

1. erecting at horizontally spaced locations at least two forms for a setable, plastic material, said forms each defining a vertical support section and at least one horizontal support section;
2. positioning a prefabricated floor element on the horizontal support sections of said forms, said floor element partially spanning the horizontal distance between the vertical support sections of said forms;
3. placing a setable, plastic material in each of said forms, said material forming in each form a support element having a vertical portion and at least one horizontal portion with the horizontal portion forming a rigid connection with said floor element; and,
4. removing said forms after said plastic material has set.

2. The method of claim 1 wherein said forms are erected at horizontally spaced locations such that the length of the prefabricated floor element will be within the range of 70 to 90 per cent of the distance between said vertical support sections.

3. The method of claim 1 wherein said forms are erected so that the resulting vertical portion of said setable, plastic material formed support element is a wall.

4. The method of claim 1 wherein said forms are erected so that the resulting vertical portion of said setable, plastic material formed support element is a column.

5. The method of claim 1 wherein said forms are erected so that the resulting vertical portion of said setable, plastic material formed support element is a frame.

6. The method of claim 1 further comprising erecting at horizontally spaced locations and in vertically alignment with two previously formed support elements two forms for a setable, plastic material, said forms each defining a vertical support section and at least one horizontal support section and, thereafter, repeating steps 2 through 4.

7. The method of claim 1 wherein said forms are erected so that the resulting vertical support element has a portion which extends above the horizontal portion.

8. The method of claim 1 wherein said setable plastic material is concrete.

9. The method of claim 1 wherein said forms each have two horizontal support sections positioned on opposite sides of said vertical support section and wherein said setable plastic material is placed in said forms to form a support element having a vertical portion and two horizontal portions with at least one of said horizontal portions forming a rigid connection with said floor element.

10. The method of claim 9 further comprising erecting at least three of said forms at horizontally spaced locations and positioning a prefabricated floor element between at least the first and second forms and the second and third forms on horizontal support sections thereof with said setable, plastic material formed horizontal portion support element forming a rigid connection with each of said prefabricated floor elements.

* * * * *